United States Patent [19]

Taylor

[11] Patent Number: 4,824,398

[45] Date of Patent: Apr. 25, 1989

[54] SOLDERABLE STANDOFF BOARDLOCK

[75] Inventor: Robert L. Taylor, Mechanisburg, Pa.

[73] Assignee: AMP Incorporated, Harrisburg, Pa.

[21] Appl. No.: 86,880

[22] Filed: Aug. 21, 1987

[51] Int. Cl.[4] ..... H01R 13/648

[52] U.S. Cl. ..... 439/557; 439/83; 439/607

[58] Field of Search ..... 439/47, 76, 83, 84, 439/92, 552, 557, 607–610, 876

[56] References Cited

U.S. PATENT DOCUMENTS

| | | | |
|---|---|---|---|
| 2,441,907 | 5/1948 | Schmitt | 439/552 |
| 3,217,584 | 12/1962 | Amesbury . | |
| 4,435,031 | 3/1984 | Black et al. . | |
| 4,518,209 | 5/1985 | Negley | 439/92 |
| 4,585,295 | 4/1986 | Ackerman . | |
| 4,659,156 | 4/1987 | Johnescu et al. . | |
| 4,721,473 | 1/1988 | DelGuidice et al. | 339/17 |

OTHER PUBLICATIONS

AMP Incorporated Drawing #.

*Primary Examiner*—Eugene F. Desmond
*Attorney, Agent, or Firm*—David L. Smith

[57] ABSTRACT

An electrical connector assembly (10) including a boardlock (14) for mounting in an aperture (70) in a printed circuit board (68). The boardlock (14) has mounting leg means (52) extending from body (44) to free ends(58) that are effective springs, extending to above the upper surface (72) of the printed circuit board (68) on which the boardlock (14) is mounted. The leg means (52) have a shoulder (56) and a tapered section (60, 84) intermediate body (44) and free ends (58). The shoulder (56, 82) cooperates with the tapered section (60, 84) to engage the upper and lower surfaces (72, 76) of the printed circuit board (68), thereby securing the boardlock (14) or connector assembly (10) to printed circuit board (68). Boardlock (14) may have tapered lead-in surfaces (64) adjacent free ends (58) to facilitate insertion of boardlock (14) into aperture (70).

26 Claims, 4 Drawing Sheets

34
32
40
30
12
28
36
26
34
24
10
20
14
30
22
32
16
38
24
42
70
68
14
78
72
68
76
70

SOLDERABLE STANDOFF BOARDLOCK

BACKGROUND OF THE INVENTION

This invention relates to securing an electrical connector assembly to a printed circuit board and in particular to a solderable standoff boardlock to secure an electrical connector assembly to a printed circuit board with the connector secured a predetermined distance from the printed circuit board.

Securing a connector to a printed circuit board a predetermined distance therefrom has been achieved using a bushing crimped into an aperture in the printed circuit board. The connector was placed on top of the bushing with connector solder tails extending through an array of apertures in the printed circuit board. Other components were stuffed into the board and all components were soldered in a wave solder process. Subsequently, the connectors were secured to the bushing concomitant to securing a cover over the circuit board. Since the connector flange was drawn to engage the bushing, contacts which were secured to the board in the soldering process, were occasionally pushed out of position in the connector housing.

Other prior art boardlocks have provided spring members that did not extend above the upper surface of the printed circuit board on which they were mounted or boardlocks that were designed for a circuit board of a specific thickness. An example is the boardlock disclosed in U.S. Pat. No. 4,435,031.

U.S. Pat. No. 4,435,031 discloses a snap latch for securing a connector block to a printed circuit board. The snap latch is typically molded plastic and has resilient prongs having latches thereon. The prongs upon being inserted into an aperture in a printed circuit board from a first side of the board deflect inwardly toward the axis of the snap latch. Upon the latches on the ends of the prongs passing through the printed circuit board, the prongs snap back into a substantially unbiased position with shoulders on the latches extending beyond the periphery of the aperture and engaging a second side of the printed circuit board, thereby securing the block to the printed circuit board. The snap latch may be an integral part of the connector housing or, if separate, may have a similar configuration of prongs to also secure the snap latch in an aperture in the connector block.

SUMMARY OF THE INVENTION

In accordance with the present invention a standoff boardlock is adapted to secure a connector to a printed circuit board with a connector housing a predetermined distance from the printed circuit board. The boardlock is secured at a first end of the body to a flange on the shell of the connector. A pair of spring means extend from the second end of the body to free ends. Each spring means has a shoulder located intermediate the second end of the body and the free end. The shoulder cooperates with a tapered section of the spring means to engage the upper and lower surfaces of a printed circuit board at the periphery of an aperture in which the boardlock is inserted. With the tapered section and the shoulder at the points of engaging the printed circuit board adapted to be spaced the thickness of a printed circuit board, the shoulder may engage either the upper or lower surface surface of the printed circuit board with the tapered section of the spring means engaging the other board surface. In a preferred embodiment, each spring means has a shoulder located intermediate the second end of the body and the free end with the shoulder directed toward the free end, a diverging section intermediate the shoulder and the free end and a converging section adjacent the free end. The converging and diverging sections converge and diverge respectively with respect to the longitudinal axis of the boardlock. When the boardlock is mounted to the printed circuit board, the free ends pass into and through an aperture until the shoulder engages the first side of the printed circuit board and the second side of the printed circuit board engages the diverging section of the boardlock thereby securing the boardlock to the printed circuit board.

DESCRIPTION OF THE PREFERRED EMBODIMENT

Figure 1:
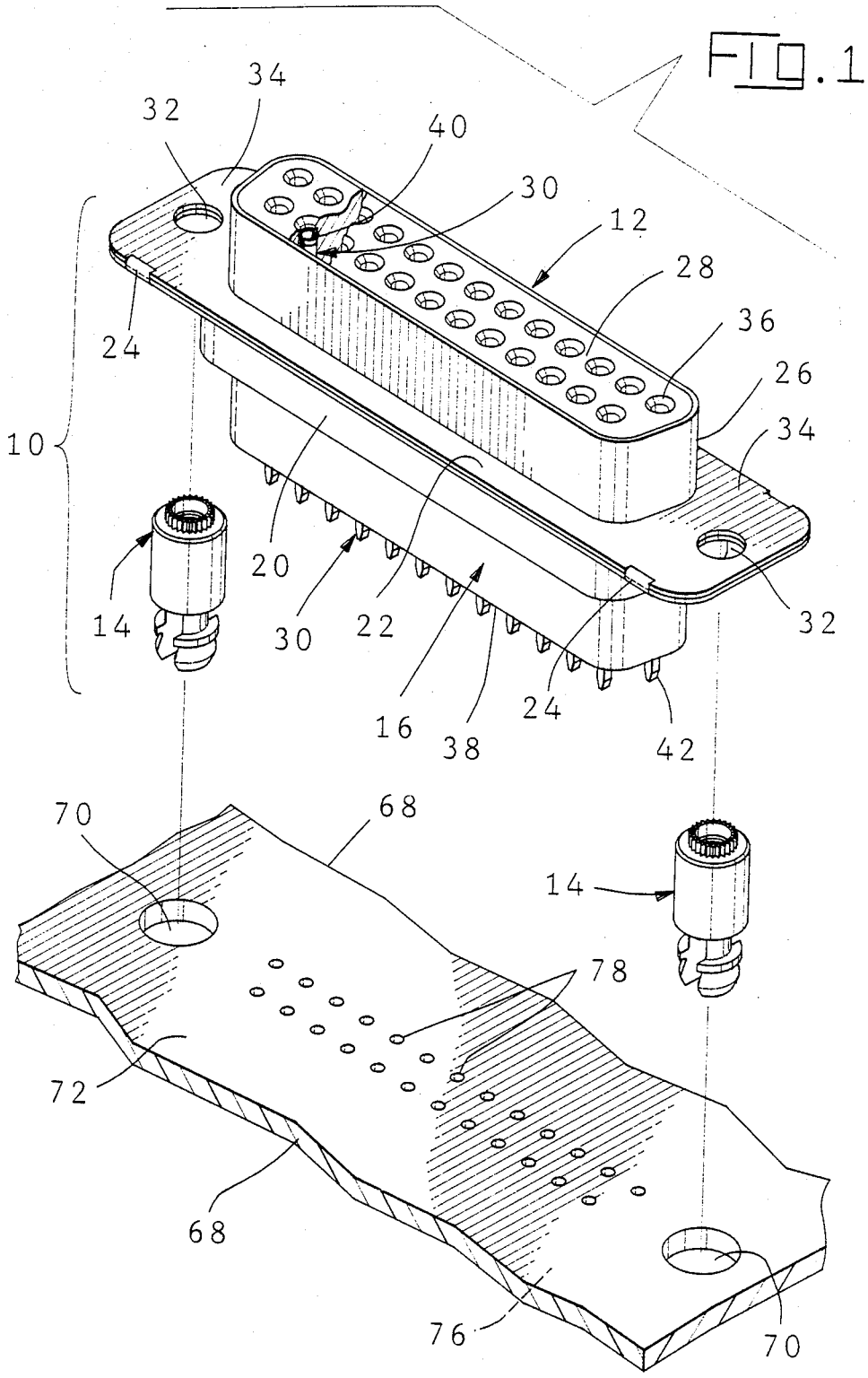
FIGURE 1 is an exploded perspective view, partly in section, of an electrical connector assembly including a boardlock in accordance with the present invention.

FIG. 1 of the Drawing depicts an exploded perspective view of a connector assembly 10 in accordance with the present invention. Connector assembly 10 is comprised of connector 12 and boardlock 14.

Connector 12 comprises a thermoplastic housing 16, which may be molded in more than one piece, received in an aperture 18 (see FIG. 5) in rear shell member 20. Rear shell member 20 and forward shell member 22 are mechanically and electrically secured together such as by tabs 24 on forward shell member 22 folded over an edge of rear shell member 20.

Forward shell member 22 has a forwardly extending shroud 26 having the shape of a subminiature D connector. Shroud 26 surrounds mating face 28 to shield contacts 30 within the shroud. Shroud 26 engages the shell of a complementary connector (not shown) to electrically common shielding therebetween when connector assembly 10 is mated to a complementary shielded connector. Rear and forward shell members 20, 22 have aligned apertures forming mounting apertures 32 in integral flanges 34.

A plurality of contact receiving passages 36 extend between mating face 28 and rear face 38 of housing 16 with contacts 30 secured therein. Contacts 30 have a mating portion 40, typically a pin or socket, extending proximate mating face 28 and a mounting portion 42, typically a solder tail, extending from rear face 38.

Figure 2:
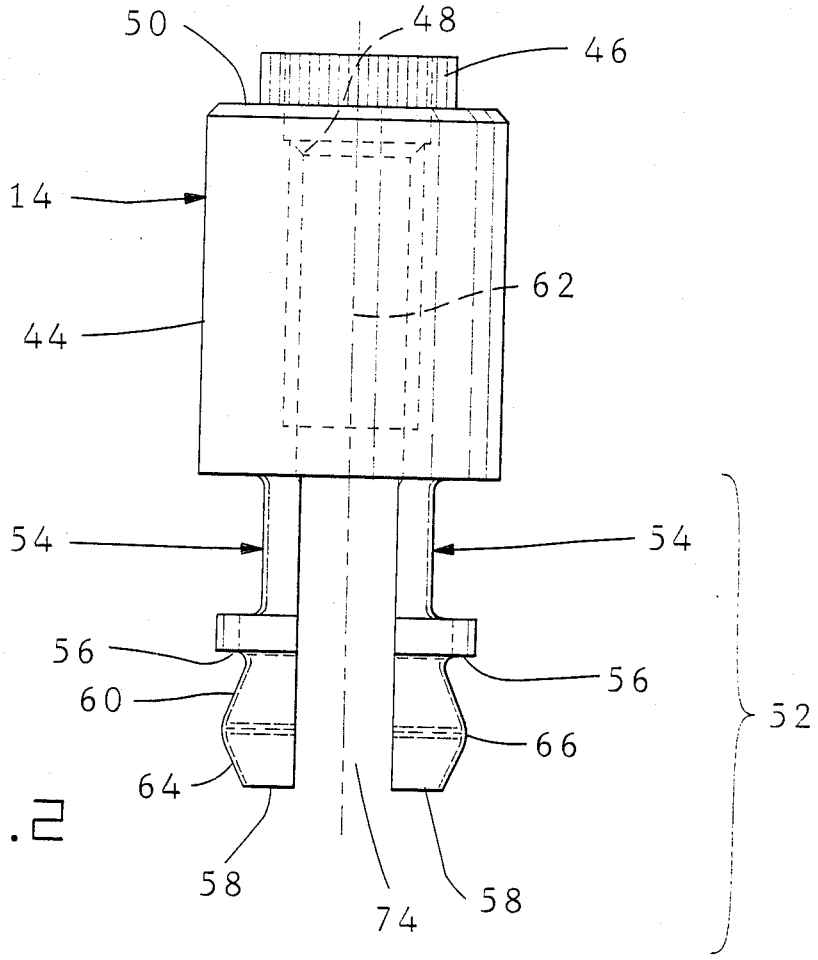
FIG. 2 is an enlarged view of the boardlock.

As best seen in FIG. 2, boardlock 14 has a central body portion 44 with an externally knurled extension 46 surrounding an internally threaded recess 48 at a first end thereof. Knurled extension 46 is adapted to be received in mounting apertures 32 in an interference fit thereby securing boardlock !4 to connector 12 forming connector assembly 10, and assuring electrical continuity between boardlock 14 and shell members 20 and 22. Boardlock 14 is, in the preferred embodiment, received in aperture 32 until rear shell member 20 engages upper surface 50 of body portion 44 thereby providing stability to boardlock 14. The knurling and interference fit prevent boardlock 14 from rotating when a screwlock from a complementary connector is threaded into recess 48. Knurled extension 46, in a preferred embodiment, is flaired after being inserted into mounting aperture 32 to enhance mechanical attachment to shell members 20, 22 as well as electrical continuity therebetween.

Extending from a second end of body portion 44, boardlock 14 has means for securing the boardlock to a printed circuit board. In a preferred embodiment, the securing means are leg means 52 that collectively have a cylindrical outer profile. Each leg portion 54 has an outwardly directed arcuate shoulder 56 located intermediate the second end of body portion 44 of boardlock 14 and the free end 58 of leg portion 54, directed toward free end 58. Leg portions 54 have a diverging section 60 adjacent shoulder 56 between shoulder 56 and free end 58. Diverging section 60 diverges from the longitudinal axis 62 of boardlock 14 in the direction from shoulder 56 to free end 58. Between diverging section 60 and free end 58, leg portions 54 have a converging section 64 with the common point of diverging section 60 and converging section 64 being apex 66. Converging section 64 converges toward longitudinal axis 62 of boardlock 14 in the direction from apex 66 to free end 58. Shoulder 56 extends transversely from axis 62 a greater distance than apex 66.

Figure 3:
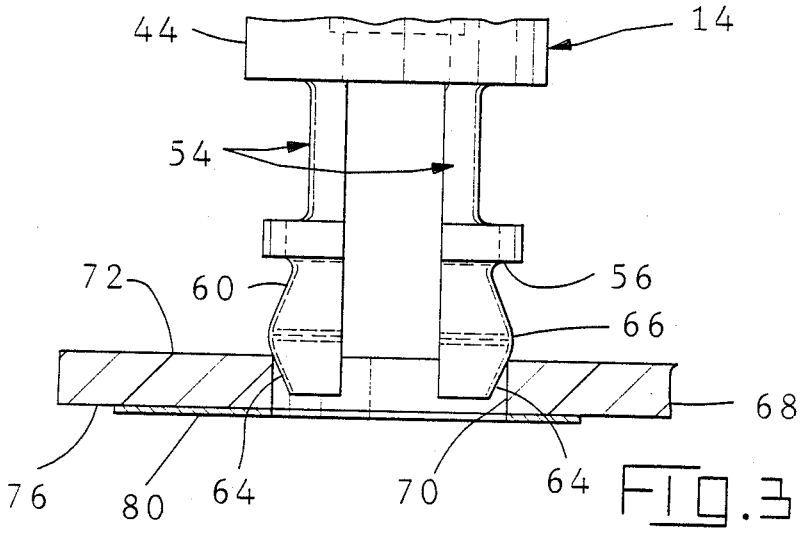
FIG. 3 is an enlarged partial view of the boardlock with the tapered lead in engaging the upper surface of a printed circuit board.

Boardlock 14 is mounted in a printed circuit board 68 by axially aligning the boardlock with an appropriately sized aperture 70 in the printed circuit board 68 then axially moving the connector assembly 10, including boardlock 14, toward printed circuit board 68. As boardlock 14 is mounted to printed circuit board 68, converging section 64 engages the periphery of aperture 70 at upper surface 72 and provides a tapered lead-in as free ends 58 are received in aperture 70 as shown in FIG. 3. As converging section 64 moves past upper surface 72, the axial force causing the relative motion causes a reaction between converging section 64 and upper surface 72 which in turn causes leg portions 54 to deflect inward toward longitudinal axis 62. Leg portions 54 being spring members flex along the length thereof from the free end 58 to the second end of body 44. Leg portions 54 thus flex from free end 58 to above shoulder 56 where upper surface 72 seats thereby providing a more effective spring. Space 74 between leg portions 54 provide for inward deflection of free ends 58. Space 74 in the preferred embodiment extends the full length of leg portions 54 from free end 58 to the second end of body 44, however, the invention is not limited thereto. The leg portions 54 could have a gap therebetween and be joined at what has been referred to as the free ends 58 thereof as well as to the body of boardlock 14. Leg portions 54 would still function as spring members.

Figure 4:
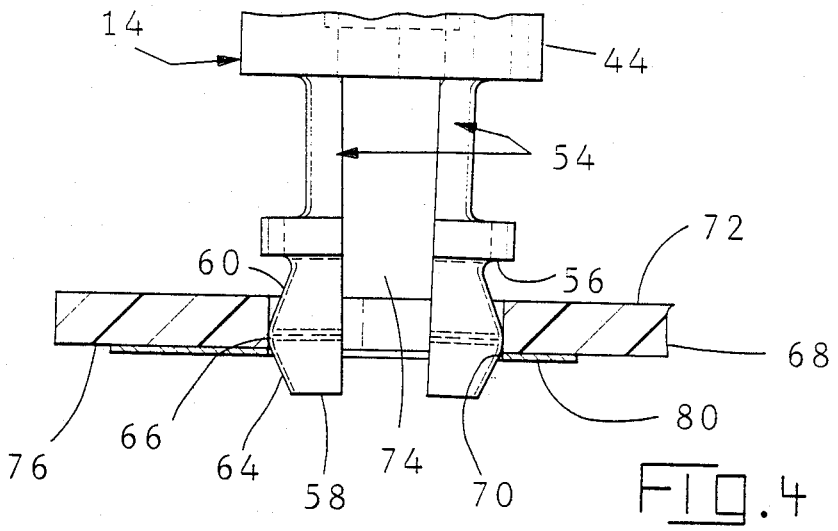
FIG. 4 is an enlarged partial view of the boardlock with the mounting leg means at the maximum deflection.

As shown in FIG. 4, leg portions 54 are deflected the greatest distance when apex 66 enters aperture 70. Boardlock 14 continues to be inserted until apex 66 exits from aperture 70 passing beyond lower surface 76. As lower surface 76 rides up diverging section 60, leg portions 54 relax, moving away from axis 62 toward their unbiased position.

Figure 5:
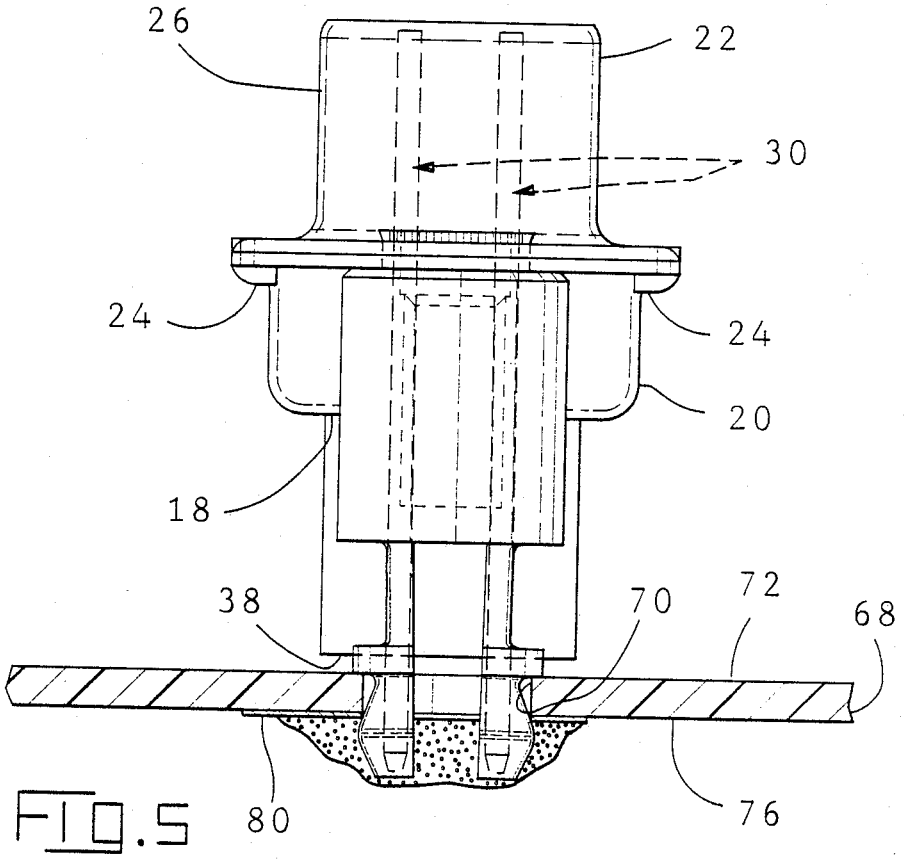
FIG. 5 is an enlarged view of the connector assembly with the boardlock seated on a printed circuit board and soldered thereto.

Boardlock 14 is seated with upper surface 72 engaging shoulder 56 and lower surface 76 engaging diverging section 60, as shown in FIG. 5, with leg portions 54 in a partially biased condition but less biased than with apex 66 in aperture 70. Shoulders 56 thus extend beyond aperture 70 to provide a surface on which surface 72 peripheral to aperture 70 can bear. In a preferred embodiment, shoulders 56 do not extend transversely from axis 62 as far as body 44 so that a tool can surround leg means 52 and engage the second end of body 44 during nsertion of knurled extension into mounting aperture 32.

In this manner, boardlock 14 is tolerance forgiving both in the thickness of printed circuit board 68 and in the diameter of aperture 70 thereby increasing the range of tolerances. Due to the bias remaining on leg portions 54 when shoulders 56 are seated on upper surface 72 and the increased bias if the axis of boardlock 14 is skewed from the axis of aperture 70, boardlock 14 tends to be self seating once inserted into aperture 70.

The height of diverging section 60 along longitudinal axis 62 is selected to accommodate a predetermined printed circuit board 68 thickness and aperture 70 diameter. The angles of diverging section 60 and converging section 64 relative to a reference such as longitudinal axis 62 are chosen to balance retention and insertion forces.

As boardlock 14 is received in aperture 70, mounting portion 42 of contacts 30 are received in respective printed circuit board 68 apertures 78 (see FIG. 1). Mounting portion 42 and boardlock 14 are soldered along with other components on printed circuit board 68, typically in a wave solder process. In preparation for soldering, boardlock 14 during manufacture is typically plated with matt tin lead.

Aperture 70 is typically a plated through hole, connected to trace 80 such that when boardlock 14 is soldered as shown in FIG. 5, an electrical path is completed from the shielding of a complementary connector through shell members 20 or 22, or through mating face hardware threaded into recess 48, through boardlock 14 to a ground trace such as trace 80 on printed circuit board 68. Boardlock 14 thus provides an electrical path to ground for shielding.

When the mounting portion 42 of contacts 30 and boardlock 14 are soldered, solder is drawn into space 74 between leg portions 54. It may be desirable or undesirable to permit solder to fill space 74 and bridge over. The size of space 74 may be adjusted to accomplish the desired result.

Figure 6:
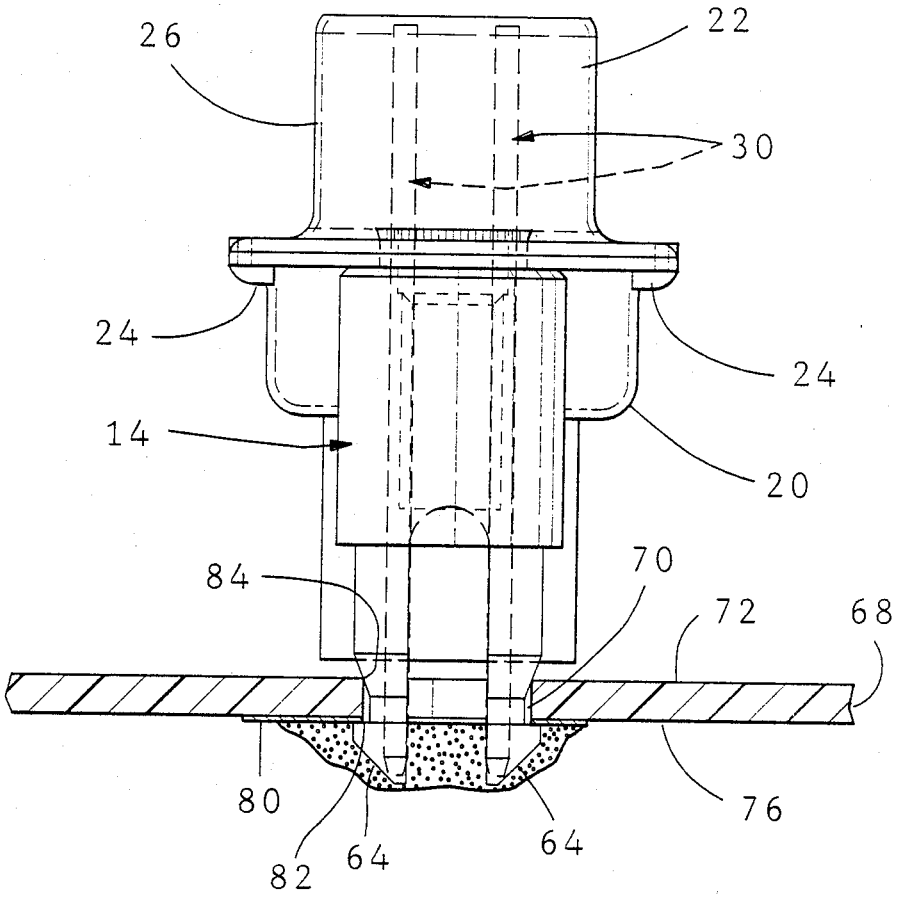
FIG. 6 is an enlarged view of the connector assembly with an alternate embodiment boardlock seated in a printed circuit board and soldered thereto.

FIG. 6 shows an alternate embodiment of boardlock 14 incorporated in connector assembly 10. In the alternate embodiment, printed circuit board 68 is secured between a shoulder 82 and a cooperating tapered section 84 of leg portions 54. Both shoulder 82 and tapered section 84 are located intermediate the second end of body 44 and free ends 58 of boardlock 14. With shoulder 82 below board 68 and tapered section 84 above board 68, tapered section 84 diverges from longitudinal axis 62 in the direction from free ends 58 to body 44.

Shoulder 82 cooperates with tapered section 84 to engage the upper and lower surfaces 72, 76 of printed circuit board 68 at the periphery of aperture 70. Tapered lead-in surfaces 64 adjacent free ends 58 facilitate insertion of boardlock 14 into aperture 70. Leg portions 54 flex inwardly toward longitudinal axis 62 upon insertion of boardlock 14 into aperture 70. With boardlock 14 inserted from upper surface 72, as shown in FIG. 6, upon shoulders 82 passing through aperture 70, leg portions 54 snap outwardly from longitudinal axis 62 into a substantially unbiased position with shoulders 82 engaging lower surface 76 and upper surface 72 engaging tapered section 84.

I claim:

1. A connector assembly for mounting to a printed circuit board, comprising:

a dielectric housing defining a mating face and a mounting face, said housing having a plurality of terminal receiving passages extending between the mating and mounting faces, said terminal receiving passages having terminals secured therein;

means surrounding said housing for shielding said housing, said shielding means having flange means extending beyond the housing, said flange means having an aperture therein;

a standoff boardlock having a body having an axis, first and second ends, said boardlock secured at said first end to said aperture; and a pair of spring means extending from the second end of the body to respective free ends, each of said spring means having a shoulder extending outward from the axis and a cooperative tapered section, said shoulder and said tapered section located intermediate the second end of the body and the free end thereof, said spring means adapted to be inserted into and seated in an aperture in the printed circuit board with a first surface of the printed circuit board received against said shoulder and a second surface of the printed circuit board engaging said tapered section, whereby the boardlock is secured to the printed circuit board.

2. A connector assembly for mounting to a printed circuit board as recited in claim 1 wherein the mounting face of the dielectric housing is adapted to be mounted a predetermined distance from the circuit board on which the connector assembly is adapted to be mounted.

3. A connector assembly for mounting to a printed circuit board as recited in claim 1 further comprising a converging section adjacent said free ends, whereby the converging section provides the boardlock with a tapered lead-in to facilitate insertion into an aperture.

4. A connector assembly for mounting to a printed circuit board as recited in claim 1 wherein said shoulder extends transversely of said axis less distance than the body periphery.

5. A connector assembly for mounting to a printed circuit board as recited in claim 1 wherein the length of the tapered section along the axis of the boardlock is at least as great as the thickness of the printed circuit board on which the boardlock is adapted to be mounted.

6. A standoff boardlock for securing a connector assembly having a connector housing to a printed circuit board, comprising:

a body having first and second ends;

means at the first end of the body for securing the standoff to a connector housing;

a pair of spring means extending from the second end of the body to respective free ends, each of said spring means having a shoulder extending outward from the axis and a cooperative tapered section, said shoulder and said tapered section located intermediate the second end of the body and the free end thereof, said spring means adapted to be inserted into and seated in an aperture in the printed circuit board with a first surface of the printed circuit board received against said shoulder and a second surface of the printed circuit board engaging said tapered section, whereby the boardlock is secured to the printed circuit board.

7. A standoff boardlock as recited in claim 6 wherein the means for securing the standoff to a connector housing comprises a knurled extension adapted to be received in an aperture in the connector housing.

8. A standoff boardlock as recited in claim 6 wherein the length of the tapered section along the axis of the boardlock is at least as great as the thickness of the printed circuit board on which the boardlock is adapted to be mounted.

9. A standoff boardlock as recited in claim 6 wherein the spring means have a cylindrical outer profile.

10. A standoff boardlock as recited in claim 9 wherein the shoulder is arcuate.

11. A connector assembly for mounting to a printed circuit board, comprising:

a dielectric housing defining a mating face and a mounting face, said housing having a plurality of terminal receiving passages extending between the mating and mounting faces, said terminal receiving passages having terminals secured therein;

means surrounding said housing for shielding said housing, said shielding means having flange means extending beyond the housing, said flange means having an aperture therein;

a standoff boardlock having a body having an axis, first and second ends, said boardlock secured at said first end to said aperture; and a pair of spring means extending from the second end of the body to respective free ends, each of said spring means having a shoulder located intermediate the second end of the body and the free end thereof, said shoulder directed toward said free end, said spring means having a diverging section intermediate said shoulder and said free end, and a converging section intermediate said diverging section and said free end, said diverging section extending transverse to and diverging from a longitudinal axis of said boardlock in the direction from said shoulder toward said free end, said converging section extending transverse to and converging toward the longitudinal axis of said boardlock in the direction from said shoulder toward said free end, whereby when the boardlock is mounted to the printed circuit board by passing the free ends of the spring means into an aperture therein, the shoulder engages a first side of the printed circuit board and the second side of the printed circuit board engages the diverging section of the boardlock thereby securing the boardlock to the printed circuit board thereby securing the connector assembly to the printed circuit board.

12. A connector assembly for mounting to a printed circuit board as recited in claim 11 wherein the mounting face of the dielectric housing is adapted to be mounted a predetermined distance from the circuit board on which the connector assembly is adapted to be mounted.

13. A connector assembly for mounting to a printed circuit board as recited in claim 11 wherein said converging section is adjacent said free end.

14. A connector assembly for mounting to a printed circuit board as recited in claim 11 wherein said shoulder extends transversely of said axis less distance than the body periphery.

15. A connector assembly for mounting to a printed circuit board as recited in claim 11 wherein the length of the diverging section along the axis of the boardlock is at least as great as the thickness of the printed circuit board on which the boardlock is adapted to be mounted.

16. A connector assembly for mounting to a printed circuit board as recited in claim 11 wherein said diverging section and said converging section are contiguous, defining an apex.

17. A connector assembly for mounting to a printed circuit board as recited in claim 11 wherein the apex is closer o the axis of the boardlock than the body periphery.

18. A connector assembly for mounting to a printed circuit board as recited in claim 11 wherein the spring means have a cylindrical outer profile.

19. A connector assembly for mounting to a printed circuit board as recited in claim 8 wherein the shoulder is arcuate.

20. A standoff boardlock for securing a connector assembly having a connector housing to a printed circuit board, comprising:

a body having first and second ends;

means at the first end of the body for securing the standoff to a connector housing;

a pair of spring means extending from the second end of the central body to respective free ends, each of said spring means having a shoulder located intermediate the second end of the body and the free end thereof, said shoulder directed toward said free end, said spring means having a diverging section intermediate said shoulder and said free end, and a converging section intermediate said diverging section and said free end, said diverging section extending transverse to and diverging from a longitudinal axis of said boardlock in the direction from said shoulder toward said free end, said converging section extending transverse to and converging toward the longitudinal axis of said boardlock in the direction from said shoulder toward said free end, whereby when the boardlock is mounted to the printed circuit board by passing the free ends of the spring means into an aperture therein, the shoulder engages a first side of the printed circuit board and the second side of the printed circuit board engages the diverging section of the boardlock thereby securing the boardlock to the printed circuit board.

21. A standoff boardlock as recited in claim 20 wherein the means for securing the standoff to a connector housing comprises a knurled extension adapted to be received in an aperture in the connector housing.

22. A standoff boardlock as recited in claim 20 wherein a common point between the diverging and converging sections defines an apex that is closer to the axis of the boardlock than the body periphery.

23. A standoff boardlock as recited in claim 20 wherein the shoulder extends transversely of said axis less distance than the body periphery.

24. A standoff boardlock as recited in claim 20 wherein the length of the diverging section along the axis of the boardlock is at least as great as the thickness of the printed circuit board on which the boardlock is adapted to be mounted.

25. A standoff boardlock as recited in claim 20 wherein the spring means have a cylindrical outer profile.

26. A standoff boardlock as recited in claim 25, wherein the shoulder is arcuate.

* * * * *